United States Patent [19]

Perry

[11] Patent Number: 4,793,438

[45] Date of Patent: Dec. 27, 1988

[54] SCAFFOLD LATCH MEANS

[76] Inventor: Eugene D. Perry, P.O. Box 306, Mooresville, Ind. 46158

[21] Appl. No.: 135,648

[22] Filed: Dec. 21, 1987

Related U.S. Application Data

[63] Continuation-in-part of Ser. No. 907,798, Sep. 16, 1986, and a continuation-in-part of Ser. No. 934,825, Nov. 25, 1986, abandoned.

[51] Int. Cl.[4] ..... E04G 1/20

[52] U.S. Cl. ..... 182/112; 182/187; 182/179; 182/118; 292/173; 292/169.14

[58] Field of Search ..... 182/118, 119, 179, 187, 182/178, 211, 184, 179, 112; 248/188.5, 407–409; 292/173, 150, 169.14; 408/146

[56] References Cited

U.S. PATENT DOCUMENTS 3,396,817 8/1968 Perry ..... 182/187

4,159,838 7/1979 Wilzig et al. ..... 292/150

FOREIGN PATENT DOCUMENTS 677582 8/1952 United Kingdom ..... 292/150

*Primary Examiner*—Alvin C. Chin-Shue

*Attorney, Agent, or Firm*—Robert A. Spray

[57] ABSTRACT

A safety device from a scaffold latch, providing a movable abutment arm which is supported to have two positions, a first position providing a blocking abutment which blocks latch-releasing withdrawal movement of the latch pin, and a second position in which it permits such latch-release movement of the latch pin, the abutment arm being co-operative with the release lever of the latch assembly to cause its movement to its second position automatically as the latch release lever is being actuated; and a spring automatically holds the safety's abutment arm in its first (pin-blocking) position unless the pin-release lever is being actuated.

23 Claims, 2 Drawing Sheets

SCAFFOLD LATCH MEANS

RELATION TO PENDING CASES

The present application is a Continuation-in-Part of pending U.S. patent applications, respectively Ser. No. 907,798 filed Sep. 16, 1986, and 934,825 filed Nov. 25, 1986 now abandoned, both entitled "Adjustable Scaffold Latch Means," all of the present inventor.

FIELD AND BACKGROUND OF THE INVENTION

The present invention applies to scaffolds, particularly useful for adjustable-height scaffolds; and except for a novel safety feature for providing safety against inadvertent pin release, the invention relates to adjustable-height scaffolds such as set forth in the said Patent and the said Applications, especially as to a combination embodying a latch-release lever such as set forth in the Applications.

Such scaffolds have a spring-pressed pin to hold the platform to the scaffold legs, and the spring provides some safety of maintaining latch-pin engagement.

Further safety against inadvertant latch-pin withdrawal is provided by a screwthread feature, in that Patent and both Applications, of mating screwthreads provided respectively on the latch-pin assembly and on the support bushing for the latch pin; and, with that type of safety feature, latch-pin withdrawal is effectively blocked.

As noted further herein, however, such a screwthread safety feature has long been realized to have certain disadvantages, particularly of improper use, lack of proper maintenance, rough handling, etc., and, in considerable contrast to that screwthread feature, the present invention provides novel concepts and components for automatically blocking latch-release withdrawal of the latch pin except when the latch pin is being intentionally disengaged, yet automatically releases the latch pin for withdrawal from the scaffold leg when latch-disengagement is being intentionally desired and achieved.

Thus, great advantage over the prior art is provided, against whatever might be the cause or cause-contribution to inadvertent pin-release, such as a weak or broken spring, a forgetting by the user to engage the screwthread safety, accidental bumping or jarring, etc.; and much less maintenance need be provided, and much less safety instruction and procedural policies need be administered, etc.

PRIOR ART STRUCTURES AND CONCEPTS DO NOT PROVIDE THE PARTICULARS AND CHARACTERISTICS HERE ACHIEVED

In considering the nature of the present safety latch device and its co-operating components and concepts, and the inventive nature of the present concepts over prior art devices as known to the inventor, it is not only conceded but emphasized that there are prior art latch devices which provide some safety against accidental latch-disengagement; and the closest known to the inventor are those set forth in his prior (1968) U.S. Pat. No. 3,396,817 which is also shown in presently-pending U.S. patent applications Ser. Nos. 907,798 and 934,825.

Also, presumably there are latches in other fields, such as door-latches, which presumably have what could be referred to as a blocking abutment blocking against unintentional disengagement.

However, such attempts and devices fail to provide the present invention's concepts and specific advantages, particularly of the combination of various features and details of the invention, especially such details as the combination including the blocking abutment, its automatic release by actuation of the pin-release lever, its support by the latch frame, and other incidents of the overall combination in a scaffold.

Scaffold latches according to each of those Applications have been and still are quite advantageous, particularly as to factors of ease of latch release as achieved by the release lever, the double set of leg-holes making for ease of assembly regardless of leg-set orientation, and the ease of maintenance as provided by the more full collapsability of the non-cylindrical springs for the latch pins.

Moreover, with scaffold latches according to those applications, and those as long ago as in the early (1968) Perry U.S. Pat. No. 3,396,817, the special advantage of high safety was achieved by the use of the safety lock provided by the engagement of the mating threads of the pin-disk and of the fixed bushing which serves as a pin-support; but this safety effect was achieved only when the user would take the effort of engaging those threads.

Workmen, however, often neglect even simple steps for the safety of themselves and other workmen or users, a fact of human nature which has been long known, and something which for many years has caused a special effort in many fields to make devices and work-areas of hopefully accident-proof or even foolproof nature, as users and makers of many types of equipment have become increasingly safety conscious as a result of experience, education, governmental enforcement, etc.

Yet, even though workmen of course dislike to be injured, their tendency and apparent habit continues to often avoid safety features, even to try to bypass safety features, even though especially dangerous as to construction or repair work involving scaffolds.

And as an addition to any tendency of human nature to not bother to go to much or any effort to accept the safety of features which can provide real safety, which indeed are a feature of those other Perry scaffolds since 1968, if used, those other Perry scaffolds have had a problem, ever since 1968, of the difficulty of engaging the safety threads if poor maintenance or rough handling has permitted the threads to become burred or otherwise hard to engage.

And as to other latches having locks or other safety features, none is known to the inventor as would be obviously useful in the particular field of scaffolds, surely without non-obvious adaptation; and none are known to the inventor which would be responsive to the position or manipulation of the pin-release handle or lever.

THE PRESENT INVENTION, SUMMARIZED

It is in contrast, against the background of such prior art, which is different in concept and particulars of components and features of the overall combination, that the present safety latch device is considered.

Especially providing advantage for scaffold use, providing protection against inadvertent latch-pin release, the safety latch device comprises a release lever as in application Ser. Nos. 907,798 and 934,825; but quite in contrast to the safety feature of those Applications and the aforesaid 1968 U.S. Patent of this inventor, the present invention provides a movable abutment which is supported by the overall latch frame and abuttingly blocks pin-release movement of the latch pin, but the blocking abutment is also provided to co-operate with the release lever so that actuation of the release lever, but only that actuation, will move the blocking abutment or arm to permit latch-release movement of the latch pin. Pin-blocking and pin-releasing are both of automatic nature.

By the features thus summarized, and particularly by them in their effect as a combination, and in novel combination with the prior latch features, and in contrast to the prior art known to the inventor and to what even by hindsight might be asserted as suggestions from the prior art, the present invention provides an advantageous apparatus for achieving the goal of a novel and useful safety latch device which is automatic both in its pin-blocking and pin-release operativity.

Accordingly, although various separate concepts and components of the overall safety latch device are conceded and emphasized to have been known in the prior art, even the present inventor's own earlier Patent and Patent Application, and perhaps other prior art not known to this inventor, nevertheless the prior art not having had the particular concepts and details as here presented and as shown as different from the prior art, even only a fair amount of realistic humility, to avoid consideration of this invention improperly by hindsight, requires the concepts here to be realistically viewed as inventive in their nature.

BRIEF DESCRIPTION OF THE DRAWINGS

The above description of the novel and advantageous safety device of the present invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts of the present invention as are illustrated in this embodiment and shown applied to a scaffold.

In the drawings, in which

FIG. 1 is a front elevation view of a scaffold device provided with improved safety latch devices of the present invention, the view showing two of the safety latch devices; and although the scaffold would preferably have two more of the latch devices, i.e., one for each of the two other legs which are hidden in this view, those two other latch devices are similarly hidden in this view, being directly behind the latch device shown;

FIG. 2 is a cross-sectional view through one of the safety latch devices, the device in this view showing the latch pin in latching position or condition, the release lever being in its resting position it has when not being pulled to intentionally achieve the latch's pin-release condition, and illustrating the safety feature of the blocking arm its safety position or condition in which it is blocking the latch pin from slippage, by any causation, out of latched condition with respect to the respective scaffold leg;

FIG. 3, as a contrast to FIG. 2, is cross-sectional view through the safety latch, but in contrast to FIG. 2 shows the parts in their latch-released position or condition achieved by an intentional pull on the release lever, as indicated by the curving indication-arrow, that action causing, as an incident to the movement of the release lever, a corresponding movement of the blocker arm, as indicated by the downwardly-pointed indicator-arrow, the withdrawal of latch release movement of the latch pin being indicated by the leftwardly-pointed indicator-arrow;

FIGS. 4 and 5 are drawn adjacent one another and at the same level on the paper, with projection lines extending from each view toward the other, similarly to that of FIGS. 2 and 3, to show reference of changed positions of the blocking arm feature in its change from blocking or safety condition in FIG. 4 to its latch-released or non-blocking position in FIG. 5. More particularly:

FIG. 4 is a rearward-looking vertical cross-sectional view, shown generally as taken by Section-line 4—4 of FIG. 2, illustrating the blocker arm in raised or safety position of pin-blocking, and indicating by the chain line circle the location of abutting engagement of the latch pin against the blocker arm when it is in safety (upraised) position;

FIG. 5 is a rearward-looking vertical cross-sectional view, shown generally as taken by Section-line 5—5 of FIG. 3, illustrating the blocker arm in lowered position, and the latch pin being free of the blocker arm for permitting latch-pin-release or withdrawal movement of the latch pin;

FIG. 6 is a outward-looking vertical cross-sectional view, shown generally as taken by Section-line 6—6 of FIG. 3, illustrating the inner or rearward-facing face of the release lever and its pivot body.

DETAILED DESCRIPTION OF PREFERRED EMBODIMENT OF THE INVENTION

Figure 1:
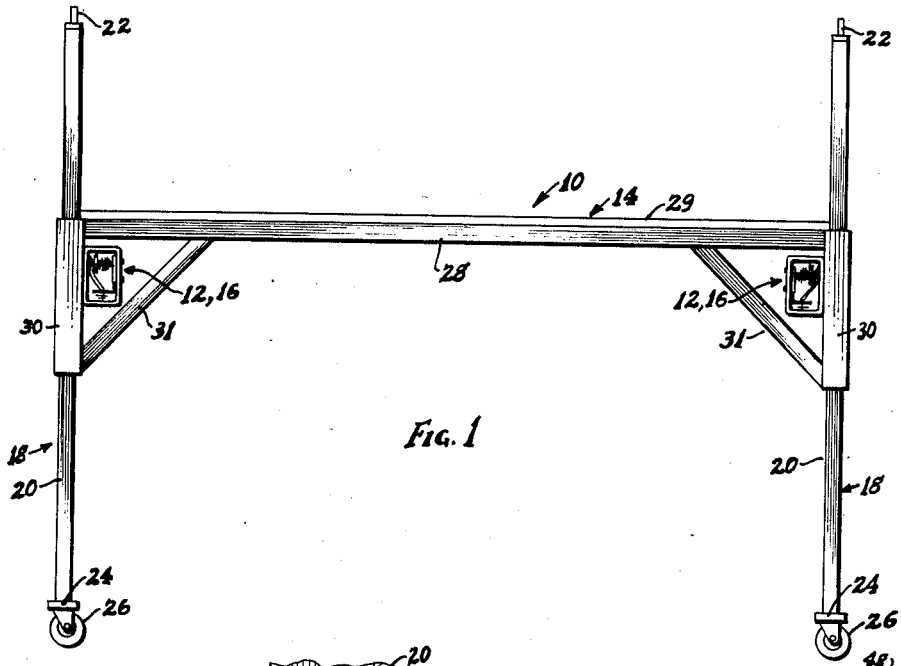
FIG. 1 is drawn to a very small scale, and the other views are drawn generally to the same although considerably enlarged scale.

As shown in the drawings, a scaffold device or unit 10 is shown provided with safety latch devices 12 of the present invention, for assuring a safely-latched support of the scaffold's horizontal working platform 14.

In this detailed description of the illustrative embodiment, although the present invention relates particularly to the latch's safety feature 16, the details and operativity of the safety feature 16 seem easiest to understand by a preliminary review of the overall scaffold 10, with its latch devices 12, its working platform 14, and its vertical end-frames 18 at each end for supporting the platform 14 at adjustable height as optionally selected by the user.

(Several of the features of the aforesaid Perry patent and applications are shown here in a preferred embodiment, as background as well as showing their inter-relation and cooperation of several of those prior devices'-features with the novel safety feature 16 of this present invention as applied to each latch 12.)

Each of the end-frames 18 of the scaffolding 10 of the Perry patent and applications is shown in FIG. 1 as having a pair of vertical legs 20 shown of U-shape in cross-section, and held for stability in spaced relationship by horizontal rods (not here shown) extending between the legs 20; and each leg 20 is shown as supplied at its upper end with an upright pin 22 for stacking a series of leg-frames, and at its lower end with a receiver plate 24 having a hole therein to receive the shank-pin of a caster 26, or the pin 22 of an adjacent leg-frame of a stacked arrangement.

The working platform 14 of the scaffolding 10 as here shown comprises a pair of side-rails 28, and end-rails (not shown) all of downwardly open U-shape in cross-section, and secured together as by welding into a unitary frame; and sheeting 29 such as of planking, tread-plate or plywood is suitably mounted thereon.

According to the support and adjustment concepts of the Perry devices, the platform 14 is shown as carrying adjacent each corner thereof a vertically-extending support 30, shown of U-shape in cross-section, which opens inwardly of the end-frame in embracing relation with its associated end-frame leg 20. The support 30 is shown as braced by a brace 31 extending from the platform 10 to a lower portion of the support 30.

To each of the scaffold's vertical supports 30, the platform 14 of the scaffolding 10 of those prior devices is shown secured, as by welding 32, a releasable holding latch means mentioned above as indicated generally by reference numeral 12 inwardly of the scaffold end-frames 18. The holding latch means 12 is shown as comprising a holding or latch pin such as a plunger 34 slidably carried for axial movement by an aligned hole 36 of a frame plate 38, and a hole 39 of the support 30, whether the latch pin 34 is in leg-latched position (FIG. 2) or unlatched position (FIG. 3). (The latch-pin's supports inwardly of the scaffold 10 are described below.)

Figure 2:
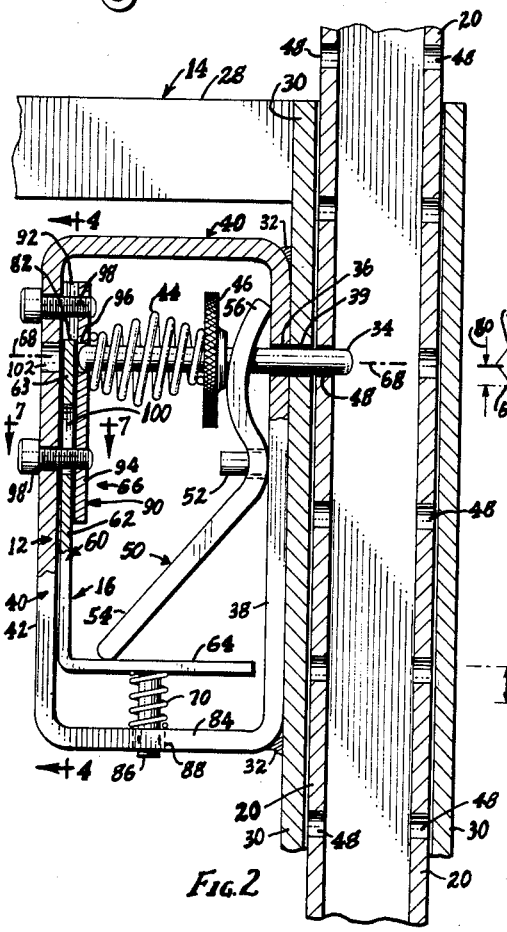
FIGS. 2 and 3 are generally similar vertical crosssectional views through one of the safety latch devices; and to illustrate by their contrast the operativity of the blocking arm of the invention, the overall latch devices of these views of FIGS. 2 and 3 are purposely drawn adjacent one another and at the same level on the paper, with projection lines extending from each view toward the other to show reference of changed positions of the blocking arm feature in response to the user pulling on the latch-release lever. More particularly.
Figure 3:
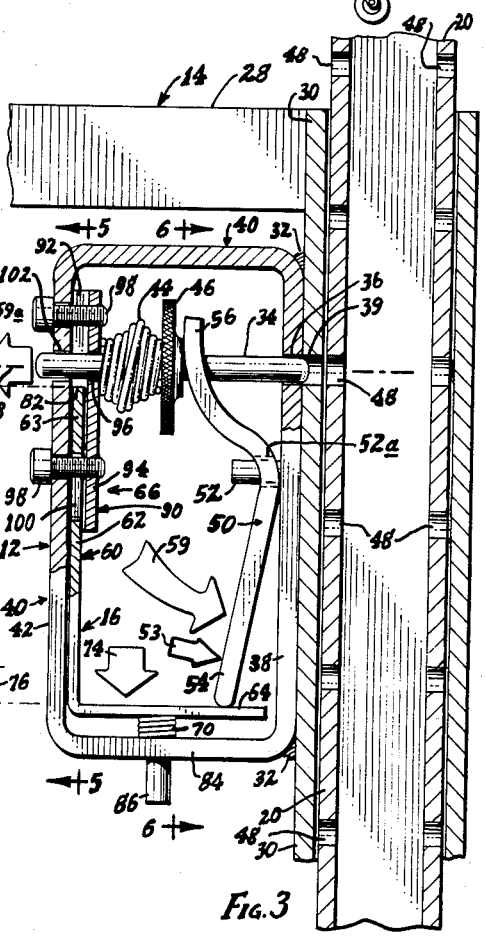

As shown, the frame plate 38, which is the part of the overall latch 12 and welded at 32 to the vertical support 30, is shown as a part of an overall frame member 40, shown here as of a generally rectangular shape, whose rear or inner wall 42 provides the functions of indirectly supporting the latch-pin 34 and of indirectly bottoming the pin-spring 44 which achieves a latching function of the latch-pin 34 with the associated scaffold leg 20, as in FIG. 2.

The latch-pin 34 is shown having welded to it an abutment arm shown as a disk 46, of a diameter significantly larger than that of the pin 34, facilitating manual but leverassisted manipulation of the pin 34 as herein described as to the operativity of achieving latch-release, easily and safely.

Between the outer vertical portion 42 (i.e., rearwardly or outwardly in the sense of being an outward portion of the overall latch assembly 12 as spaced from the leg 20, even though as shown is on an inner side of the leg 20 when the entirety of the scaffold is being considered) of the frame member 40 and the abutment disc 46 there is disposed the compression spring 44, the spring 44 being sleeved around or surrounding the pin 34; and the ends of the spring 44 bottom, respectively, on disc 46 and indirectly against wall 42 of frame 40, as noted more particularly below.

Co-operating with the pin 34 for latched support (FIG. 2) of the platform 14, as in those prior devices, the end-frame legs 20 are provided with a vertical series of supporting abutments shown as holes 46, each being adapted to supportingly receive a holding pin 34, for achieving the latching effect which holds the desired height-position of the platform 14.

The scaffold legs 20 are of a square cross-section, and, according to the cited application Ser. No. 934,825, each of the legs 20 is provided on both opposite sides with the series of optionally-usable pin-receiving holes 48; and this double-set helps achieve scaffold-erection or assembly easier, by making it a matter of indifference as to each set 18 of end-legs 20 which side thereof is facing the platform 14 during assembly of legs 20 and platform 14.

The latch effect of the latch-pins 34 in leg-holes 48 is such that only after full release of the pin 34, of the latch 12 associated with each of the two legs 20 at one end of the scaffold, can the user raise or lower that end of the platform 14 to its desired height, while holding the pins 34 withdrawn from any of the holes 48, against the bias of the spring 44 of latch-pin 34, by release means detailed below.

When the height of the platform 14 is approximately correct, the user releases those pin-discs of flange-arms 46 as detailed below; and when the platform support 30 comes to the location at which the pin 34 is in registry with one of the leg-holes 48, the bias of spring 44 pushes the pin 34 to a latched position in a leg-hole 48, as in FIG. 2, holding the desired height-adjustment, as in those prior devices.

The friction of the pin 34 in its supporting holes makes pin-withdrawal difficult, especially since the openings or holes are desirably of small enough size as to provide good support for the pin 34. However, according to the concepts of the cited Applications, unlatching of the pin 34 is made easy and convenient, even though the weight of the platform 14 is causing a tight frictional bind on the pin 34 by the components which touch it while it is in latching position; and the feature which provides advantageous means to achieve latch-pin removal is a release lever designated in full by reference numeral 50.

The lever 50, in those Applications, provides for releasing the latch means pin 34 by axial movement of the pin 34 in a direction opposite to the direction the pin means 34 are biased by the spring-pressure means 44, thus providing means for releasing the co-operating means of the pin 34 and leg-hole 48 from holding relationship, much easier than in the cited 1968 Perry patent.

More specifically as to the lever means 50, pivotal support means 52, which extend thorugh a central hole 52*a* in lever 50, movably support the lever means 50 for engaging the abutment disc means 46 of the pin means 34, with the lever means 50 extending generally transversely of the axis of the pin means 34. The lever means 50, thus supported and as thus engaging the abutment means 46 of the pin means 34, provides a conveniently squeezable and manually-actuatable force means for achieving release of the latch means pin 34, by a force indicated by force-arrow 53 (FIG. 3) which is manually applied at a location 54 spaced from the pin means 34, that location 54 being the free end of the lever 50, which is easily grasped by the user, as a "one-hand" operation for release of the pin 34 from leg-hole 48.

As shown, the support means 52 which supports the lever means 50 is itself operatively carried by the scaffold platform 14, as shown by being carried by frame member 38 of the support 30 carried by the platform 14.

Figure 6:
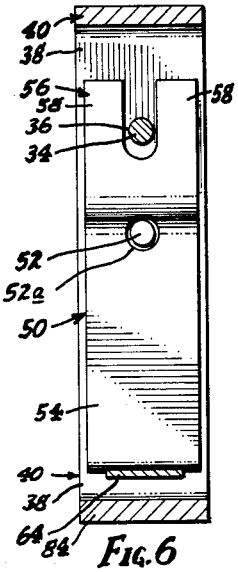

Advantage is also provided by the lever means 50 and the support means 52 which supports the lever means 50 being such that the travel of the portion 54 of the lever means 50 receiving latch-releasing force 53, when the latch-releasing (FIG. 3) force 53 is applied to move the lever-portion 54 from the position the lever 50 is in when the pin means 34 is in its (FIG. 2) latching engagement with leg-hole 48, is more than the travel of the portion 56 of the lever means 50 which engages the abutment means 46 of the pin means 34 during the latch-release or pin-withdrawal movement of the lever means 50, the support 52 serving as a fulcrum of the lever 50 between its portions 54 and 56. (The lever portion 56 (FIG. 6) is shown as of yoke-form, the yoke-arms 58 of which straddle the latch-pin 34.)

Convenience of operative effect of the lever 50 is further provided by the mounting of the lever 50 such that it is squeezable, i.e., a "one-hand" (force 53) operation in which the user reaches his thumb around the scaffold leg 20 (and the platform-support 30) and his fingers around the lever portion 54. More particularly in this regard, it will be noted that the lever means 50 and the support means 52 supporting the lever means 50 are such that the travel of the portion 54 of the lever means 50 receiving latch-releasing force 53, when latch-releasing force is applied to the lever 50 by force 53 on lever-portion 54, from the position of the lever 50 when the pin means 34 is in latching engagement with leg-hole 48, is in a direction (reference arrow 59, FIG. 3) opposite to that of the travel of the pin means 34 during release of the latch means 12 (reference arrow 59*a*, FIG. 3) in withdrawal movement of the pin means 34; and, further, the travel of the force-applied lever-portion 54 during release (arrown 59*a*, FIG. 3) of the pin 34 is in direction (arrow 59) toward the vertically extending leg 20 of the scaffolding.

A further and advantageous feature of the scaffolding 10, as shown in the drawings and per the cited application Ser. No. 934,825, is the provision of the latch-spring 44 to be provided to be of non-uniform diameter nature of its coils; and the nesting effect of the non-uniform diameter of coils of a spring 44 is seen to give high collapsibility or shortening of the spring 44 when compressed.

That extra shortening of the spring 44 is of particular advantage if and when it is desired to disassemble the components of the latch assembly 12, such as to repair or replace an assembly of latch-pin 34 and its collar disc 46, such as because of the pin 34 or its disc 46 having become unduly bent or otherwise damanged; for with sufficient shortening of the spring 44 the latch-pin 34 may be moved rearwardly (away from the leg 20 even further than shown in FIG. 3) far enough to be wholly withdrawn from the frame member 40, which is considerably farther than the routine-use retraction of the latch-pin 34.

With all that background, details of the present invention of the safety feature 16 are now described as to the illustrative embodiment shown in the drawings; and although the safety feature 16 is used in the devices generally as per the two cited Applications, it co-operates with details of their latch devices 12 in an integrated combination to the significant extent herein specified.

That is, the safety feature 16 particularly co-operates with several particulars of those prior latch devices 12, most particularly with their latch-pins 34 and the release lever 50 of the two cited Applications, but also to an extent with the scaffold's support legs 20 and their abutments or holes 48 into which the latch pin 34 extends under bias of spring 44 for supporting the support 30 and the support platform 14, and the latch's peripheral outer frame 40, and also it co-operates with the prior devices'functional operativity of the latch pin 34 being supported to be movable into and between its platform-supporting position (FIG. 2) and a withdrawn position (FIG. 3) in which the latch-pin 34 axis caused by the release lever 50 to be removed from the leg-holes 48 to an abutment-release position for permitting a change of relative position of the scaffold's platform 14.

As with the release levers 50 of those cited Applications, the release lever means 50 here has been noted as having an actuator portion 54 for receiving manual force 53, and an actuated portion 56 which by acting onto the pin-disc 46 operatively engages the latch pin 34 to cause its latch-release movement (arrow 59*a*, FIG. 3) against the bias of the pin-spring 44.

Figure 8:
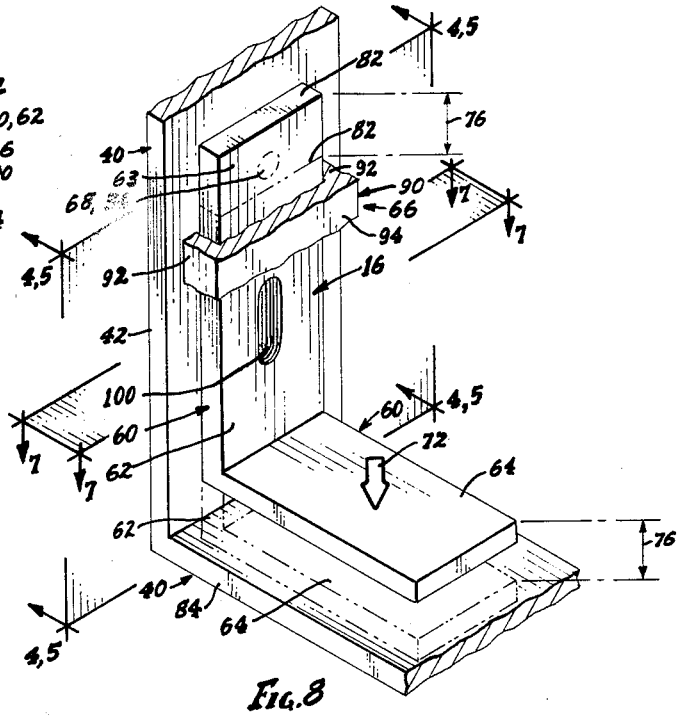
FIG. 8 is a fragmental pictorial view, as another illustration of the blocking arm feature, of the blocking arm shown in full lines in its safety-blocking position as to the latch pin, preventing latch-release withdrawal movement of the latch pin, and with "double dot" chain lines indicating the lowered position of the blocker arm feature upon the camming-down actuation of the release lever as is indicated by the downwardly-pointing indicator-arrow, and the "single dot" chain line showing the location of abutting engagement of the latch-pin against the blocker arm when the blocker arm is in raised or safety position and the release lever is in its rest-position not being pulled to purposefully achieve latch-release, that abutting-engagement location, which is in line with the latch pin's movement-axis, being shown as being a location then free of the blocker arm when and because the blocker arm is then in its downwardly-pressed position (double-dot chain lines) during latch-pin-release actuation of the release lever, and thus then permitting latch pin travel in a withdrawal movement through that engagement location to thus achieve latch-release.

Now are specified the details of the safety feature 16 itself, as follows:

According to the present invention, there is provided a movable control member generally identified by reference numeral 60, as shown (especially as in FIG. 8) to be of a general "L"-shape, its upright or vertical leg 62 providing at its upper end 63 a pin-blocking means, and its horizontal leg 64 providing an actuator means.

As detailed below, in the form shown there are provided support means 66 which support the control member 60 in and between two operative positions. That is, the support means 66 supports the control member 60 in and between a first position (FIGS. 2,4, and 8) in which its pin-blocking arm-means 63 is disposed in the path or axis 68 of withdrawal movement of the latch pin 34, thus blocking the latch-releasing movement of the latch-pin 34 from moving from its leg-abutting position (FIG. 2) of support of the support 30 and platform 14, to the latch-pin 34's withdrawn position (FIG. 3) of release of the latch-pin 34 from leg-holes 48, and a second position (FIGS. 3 and 5) in which the control member's pin-blocking means 63 is withdrawn from the pin-withdrawal axis or path 68, thus permitting the latch-pin 34 to move to its withdrawn position (FIG. 3) of release of the pin 34 from the leg-holes 48.

Also as shown a control spring 70 is provided, which biases the control member 60 to its upper position (FIGS. 2 and 4) in which its pin-blocking means 63 is in raised or pin-blocking position.

Release of that pin-blocking position of latch-pin 34 is provided by the actuator means 64 of the control member 60 being forced (indicated by force arrow 72 of FIG. 8) to be moved in response to pin-releasing movement (indicator arrow 74 of FIG. 3 and space - indicating lines 76 of FIGS. 2–5 and 8) of the control member 60 to move its pin-blocking means 63 to a lowered or withdrawn position (FIGS. 3 and 5) in which the pin 34 is no longer blocked but is movable (indicator arrow 59*a*, FIG. 3) to its withdrawn (leftward, FIG. 3) position of abutment-release with respect to the scaffold leg-hole 48.

Figure 4:
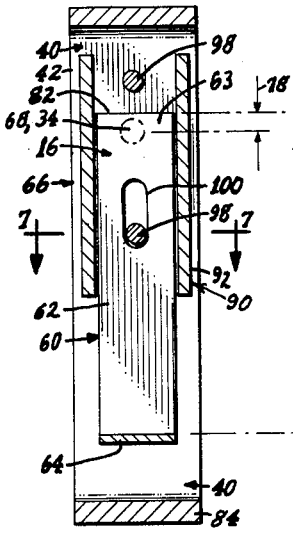
FIGS. 4–6, with FIGS. 4 and 5 being shown generally as taken by Section-plane 4,5—4,5 of FIG. 8, are vertical cross-sectional views of the safety latch device, all these views being such as would show the latch pin in transverse cross section (except that the sectional view of FIG. 4 is not within the span of the latch pin), and, for further illustration of the construction and operativity of the blocking arm and its relation to the other components.

That lowering movement of the control member 60 is also shown diagrammatically by indicator line 78 of FIG. 4 and indicator line 80 of FIG. 5, which respectively show the upper edge 82 of the pin-blocking upper portion 63 of leg 62 of control member 60 being respectively above (FIG. 4) and below (FIG. 5) the axis 68 of latch pin 34, depending, as with indicator lines 76, upon whether the release lever 50 is then being moved (arrow 59, FIG. 3) to produce the force 72 (FIG. 8) to cause the movement 74 (FIG. 3) downwardly, of control 60 and its pin-blocking portion 63.

Figure 5:
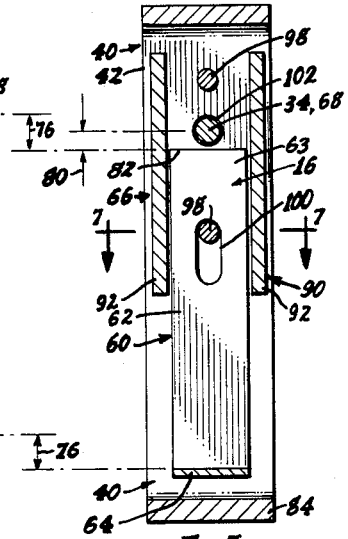

That unblocking of the pin 34 in FIG. 3, in contrast to its blocking position of FIG. 2 in which the pin 34 is blocked by the arm-abutment 63, is indicated in FIG. 3 by indicator line 80 as in FIG. 5.

It is to be noted in the form shown that the only time the latch-pin 34 can move to its withdrawn (left, FIG. 3) position sufficiently to release its abutment with the scaffold leg-hole 48 of its platform-support is while the release lever means 50 is being actuated (indicator arrow 59 in FIG. 3) to cause pin-withdrawal thrust 59*a* upon the latch-pin 34 by force 53 applied to the actuator portion 54 of the release lever means 50.

Further as shown, the shape, nature, and support of the control member 60 is such that the control member 60, and here particularly its leg 64, is cammed by the actuator portion 54 of the release lever means 50 to move the arm 62 and its pin-blocking means 63 of the control member away 60 from its pin-blocking position (FIGS. 2,4, and 8) as the release lever means 50 is being moved (59) to achieve movement of the latch pin 34 to its withdrawn position (FIG. 3) of abutment-release with respect to the scaffold leg 20.

The movement (74) of the control means 60 is automatically achieved in response to pin-release movement (59) of the manually-movable pin-release means which here is the lever 50.

As with the cited prior devices, the overall frame 40 of the latch means 12 has a generally horizontal portion 84 which provides a horizontally-extending support means; and the actuator means 64 of the control member 60 is provided to have a leg 86 extending in the same direction as is the direction of movement (74) of the pin-blocking means 63, the control spring 70 being here a compression spring sleeved around the leg 86; and the horizontal support means 84 of the frame 40 of the latch means 12 is provided with an opening 88 (FIG. 2) for accommodating the leg 86 and its movement as the control member 60 moves, here vertically, during movement of its pin-blocking means 63.

Figure 7:
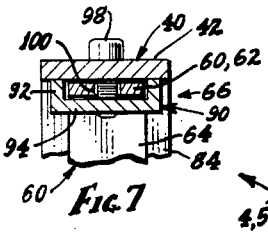
FIG. 7 is a fragmental horizontal cross-sectional view, shown generally as taken by Section-line 7—7 of FIGS. 2,4, and 5, and by Section-plane 7—7—7—7 of FIG. 8, illustrating the blocker arm being slidably retained by a channel-like body bolted to the outer frame.

Also as with the cited prior devices, the overall frame 40 of the latch means 12 is already mentioned as having a generally vertically-extending support means 42; and the support 66 of the abutment leg 62 includes a plural-effect member 90 in fixed relation to the vertical support 42, the plural-effect member 90 being shown as a channel-like member (FIGS. 7 and 8) of a general C-shape in horizontal cross-section, and the opposed webs 92 of the member 90 provide guides for the pin-blocking means 63 of the control member 60 and support the intermediate web 94 spaced from the generally vertically-extending support means 42 of the frame 40, and the intermediate web 94 provides a bottoming abutment for the pin-spring 44, the intermediate web 94 being provided with an opening means 96 (FIGS. 2 and 3) for receiving the latch pin 34 for its movement through the intermediate web 94 along axis 68.

That opening means 96 of the intermediate web 94 is provided to be operatively close to the shape of the latch pin 34 so as to be a supporting guide for the latch-pin 34 in both the latch-pin's support position (FIG. 2) of abutment with the scaffold leg-hole 48 and in its withdrawn position (FIG. 3) and in its movement between those positions.

Also as shown there are provided a pair of bolt means 98 operatively extending between the generally vertically-extending support means 42 of frame 40 and the intermediate web 94 of the plural-effect member 90, and the respective bolts 98 are on opposite sides of the latch-pin 34 and its axis or path of travel 68; that is, one of the bolt means 98 is positioned away (above as shown) from the adjacent end 82 of the pin-blocking means 63 of the control member 60 in both its positions of latch-blocking the latch pin 34 and of being withdrawn from its position of blocking the latch-pin 34, and the other one of the bolt means 98 is positioned in the position of the pin-blocking means 63 (that is, below its upper edge 82) of the control member 60 in both its positions of latch pin-blocking (FIG. 2) and of being withdrawn from latch-pin blocking (FIG. 3). The control member's pin-blocking means 63 is provided with a relief opening means 100 accommodating the presence of the lower bolt means 98 in and between both positions of the control member's pinblocking means 63.

The length of the pin 34 is such that in latch-released position (FIG. 3), and in even further leftward position as may be desired to remove the latch-pin 34 for servicing, the pin 34 would extend leftwardly even leftwardly past the plane of the blocking arm 63; and thus the vertical frame member 42 of frame 40 is provided with an opening 102 in alignment with hole 96 of web 94 and the axis 68 of the latch pin 34, also thus in alignment with holes 36 and 39, all accommodating the latch-pin 34 along its axis 68.

The bias by the spring 44 upon the abutment collar 46 of the latch-pin 34, which urges the latch-pin 34 to platform-support position with a leg-hole 48, also is utilized by the safety feature 16; for that same bias by the spring 44 holds the pin 34 out of the plane of the abutment arm 63, whenever the pin 34 is ever in support-position with a leg-hole 48, clearing the space within the channel member 90 and letting the arm 63 move into and stay into its pin-abutting position (FIGS. 2,4 and 8), that movement of arm-portion 63 into the pin-abutting position being shown as urged by the spring 70 and with the movement of the "L"-shape control member 60 being guided for its translatory movement by one or more of the effects of leg 86 in hole 88, the walls 92 and 94 of the channel member 90, the wall 42 of frame 40, and the sliding of the elongated hole 100 along the lower bolt 98.

Thus in the form shown, and with the release lever 50 in its relatively inactive position (the pin-blocked position of FIGS. 2 and 4), the abutment arm 62 stays in its pin-blocking (raised) position until the user's squeeze on the release lever 50 moves it for its relatively active position in which its actuator arm 54 is caused to engage the actuator arm 64 of the control means 60 to cause the abutment arm 63 to be lowered to its pin-unblocking (FIGS. 3 and 5) position, that movement of arm 64 also causing the spring 70 to be compressed to cause it to urge or bias the arm 63 back to pin-blocking position upon the user's release of the lever 50 and the pin 34's engagement into any of the leg-holes 48.

CONCLUSION

It is thus seen that a safety device for a scaffold latch, constructed and used according to the inventive concepts herein set forth, provides novel concepts of a desirable and advantageous device, yielding the advantages of a safety against inadvertent or unintentional latch-release of a scaffold platform, and provides special and particular advantages when used as herein set forth; and in co-operation with the actuation of a latch-release lever, automatically achieving each of pin-unblocking and pin-blocking operativity in accordance with the actuation or non-actuation of the pin-release lever.

In summary as to the nature of the overall device's advantageous concepts, their inventiveness is shown by novel features of concept and construction shown here in advantageous combination with themselves and with other components of the scaffold-latch itself, and by the novel concepts hereof not only being different from all the prior art known, but because the achievement is not what is or has been suggested to those of ordinary skill in the art, especially realistically considering this as a combination comprising components which individually are similar in nature to what is well known to most such persons. Yet no prior art has suggested the modifications of any prior art to achieve the particulars of the novel concepts here achieved, with the special advantages which the overall device provides.

The differences of concept and construction are specified herein, yielding advantages of safety by novel concept even though different type and different nature of safety devices for holding a latch-pin against inadvertent latch-release have been known and used for many years; and quite certainly no particular combination of prior art details as here presented in this overall combination has been suggested by the prior art, this achievement in its particular details being a substantial and advantageous departure from prior art, even though blocking abutments as a mechanical feature have been known for a multiplicity of uses for many years. And particularly is the overall difference from the prior art significant when the non-obviousness is viewed by a consideration of the subject matter of this overall device as a whole, advantageously getting extra function from components of prior scaffold latches, and as a combination integrally incorporating features different from the prior art, in contrast to merely separate details of novelty themselves, and further in view of the prior art devices not achieving particular advantages here achieved by this combination.

Accordingly, it will thus be seen from the foregoing description of the invention according to this illustrative embodiment, considered with the accompanying drawings, that the present invention provides new and useful concepts of a novel and advantageous safety means for a scaffold latch device, having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A latch means for a scaffold, the scaffold having a support leg having an abutment against which a latch pin of the latch means abuts for supporting a support platform of the scaffold, the latch pin being supported to be movable into and between (a) a support position in which it abuts the leg abutment for supporting the platform and (b) a withdrawn position in which the latch pin is removed from the leg abutment to an abutment-release position for permitting a change of position of the platform with respect to the leg, there being a pin-spring which biases the latch pin to its platform-supporting position in which it abuts the leg abutment, there being a release lever means, having an actuator portion and an actuated portion, the actuator portion being manually movable to cause the actuated portion to operatively engage the latch pin and to cause its movement to its said withdrawn position of leg-abutment-release, against the bias of the pin-spring, the improvement for such a latch means, comprising:

a movable control member having a pin-blocking means and an actuator means, support means which supports the control member in and between (a) a position in which its pin-blocking means is disposed in the path of the latch pin, thus blocking the latch pin from moving from its leg-abutting position of platform support to its withdrawn position, and (b) a position in which the control member's pin-blocking means is withdrawn from said path, thus permitting the latch pin to move to its withdrawn position of leg-abutment release, a control spring being provided, which biases the control member to a position in which its pin-blocking means is in pin-blocking position, the actuator means of the control member being moved in response to pin-releasing movement of the release lever means, to achieve movement of the control member to move its pin-blocking means to a withdrawn position in which the pin is movable to its withdrawn position of abutment-release with respect to the scaffold leg, the arrangement providing that the only time the latch pin can move to its withdrawn position sufficiently to release its abutment with the scaffold leg abutment of platform support is while the release lever means is being actuated to cause pin-withdrawal thrust upon the latch pin by force applied to the actuator portion of the release lever means.

2. The invention as set forth in claim 1, in a combination in which the control member is formed to have a general L-shape, one leg of it being supported in a generally vertical orientation for providing the pin-blocking means, and the other leg of which being supported in a generally horizontal orientation for providing the actuator means of the control member, and providing that the control member is cammed by the actuator portion of the release lever means to move the pin-blocking means of the control member away from its pin-blocking position as the release lever means is being moved to achieve movement of the latch pin to its said withdrawn position of abutment-release with respect to the scaffold leg.

3. The invention as set forth in claim 2, in a combination in which the latch means has a generally horizontally-extending support means, and the actuator means of the control member is provided with a leg extending in the same direction as is the direction of movement of the pin-blocking means, the control spring being a compression spring sleeved around said leg, and the said support means of the latch means being provided with an opening for accommodating said leg and its movement as the control member moves during movement of its pin-blocking means.

4. The invention as set forth in claim 1, in a combination in which the latch means has a generally vertically-extending support means, and there is provided a plural-effect member in fixed relation thereto, the plural-effect member being of a general C-shape in horizontal cross-section, the opposed webs of which provide guides for the pin-blocking means of the control member, and support the intermediate web spaced from the generally vertically-extending support means, and the intermediate web provides a bottoming abutment for the pin-spring, the intermediate web being provided with an opening means for receiving the latch pin therethrough.

5. The invention as set forth in claim 2, in a combination in which the latch means has a generally vertically-extending support means, and there is provided a plural-effect member in fixed relation thereto, the plural-effect member being of a general C-shape in horizontal cross-section, the opposed webs of which provide guides for the pin-blocking means of the control member, and support the intermediate web spaced from the generally vertically-extending support means, and the intermediate web provides a bottoming abutment for the pin-spring, the intermediate web being provided with an opening means for receiving the latch pin therethrough.

6. The invention as set forth in claim 3, in a combination in which the latch means has a generally vertically-extending support means, and there is provided a plural-effect member in fixed relation thereto, the plural-effect member being of a general C-shape in horizontal cross-section, the opposed webs of which provide guides for the pin-blocking means of the control member, and support the intermediate web spaced from the generally vertically-extending support means, and the intermediate web provides a bottoming abutment for the pin-spring, the intermediate web being provided with an opening means for receiving the latch pin therethrough.

7. The invention as set forth in claim 4, in a combination in which the opening means of the intermediate web is provided to be operatively close to the shape of the latch pin so as to be a supporting guide for the latch pin in both its support position of abutment with the scaffold leg abutment and in its withdrawn position, and in its movement between said positions.

8. The invention as set forth in claim 5, in a combination in which the opening means of the intermediate web is provided to be operatively close to the shape of the latch pin so as to be a supporting guide for the latch pin in both its support position of abutment with the scaffold leg abutment and in its withdrawn position, and in its movement between said positions.

9. The invention as set forth in claim 6, in a combination in which the opening means of the intermediate web is provided to be operatively close to the shape of the latch pin so as to be a supporting guide for the latch pin in both its support position of abutment with the scaffold leg abutment and in its withdrawn position, and in its movement between said positions.

10. The invention as set forth in claim 4, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positions of latch pin blocking and of being withdrawn from latch pin blocking, the control member's pin-blocking means being provided with a relief opening means accommodating the presence of the bolt means in and between both positions of the control member's pin-blocking means.

11. The invention as set forth in claim 5, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positions of latch pin blocking and of being withdrawn from latch pin blocking, the control member's pin-blocking means being provided with a relief opening means accommodating the presence of the bolt means in and between both positions of the control member's pin-blocking means.

12. The invention as set forth in claim 6, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positons of latch pin blocking and of being withdrawn from latch pin blocking, the control member's pin-blocking means being provided with a relief opening means accommodating the presence of the bolt means in and between both positions of the control member's pin-blocking means.

13. The invention as set forth in claim 7, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positions of latch pin blocking and of being withdrawn from latch pin blocking, the control member's pin-blocking means being provided with a relief opening means accommodating the presence of the bolt means in and between both positions of the control member's pin-blocking means.

14. The invention as set forth in claim 8, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positions of latch pin blocking and of being withdrawn from latch pin blocking, the control member's pin-blocking means being provided with a relief opening means accommodating the presence of the bolt means in and between both positions of the control member's pin-blocking means.

15. The invention as set forth in claim 9, in a combination in which there are provided a pair of bolt means operatively extending between the generally vertically-extending support means and the intermediate web of the plural-effect member, and on opposite sides of the latch pin and its path of travel, one of the bolt means being positioned away from the adjacent end of the pin-blocking means of the control member in both its positions of latch pin blocking and of being withdrawn from latch pin blocking, and the other one of the bolt means being positioned in the position of the pin-blocking means of the control member in both its positions of latch pin blocking and of being withdrawn from latch pin blocking, the control member's pin-blocking means being provided with a relief opening means presence of the bolt means in and between both positions of the control member's pin-blocking means.

16. A latch means for a scaffold, the scaffold having a support leg having an abutment against which a latch pin of the latch means abuts for supporting a support platform of the scaffold, the latch pin being supported to be movable into and between (a) a support position in which it abuts the leg abutment for supporting the platform and (b) a withdrawn position in which the latch pin is removed from the leg abutment to an abutment-release position for permitting a change of position of the platform with respect to the leg, the latch means having a manually-movable pin-release means which is operatively engageable with the latch pin to cause its movement to its said withdrawn position of leg-abutment release, the improvement for such a latch means, comprising:

a movable control means having a pin-blocking means and an actuator means, there being provided support means for the movable control means such that its pin-blocking means is moved with respect to the latch pin and into and between (a) a pin-blocking position in which it engages with the latch pin for blocking movement of the latch pin from its position of leg-abutting platform support to its said withdrawn position, and (b) a non-blocking position with respect to the latch-pin, in which the pin-blocking means is withdrawn from the pin-blocking position and is out of engagement with the latch pin, permitting the latch pin to move to its withdrawn position of leg-abutment-release, and the actuator means of the control means engages with the manually-movable pin-release means, such that the actuator means of the control means is moved in response to pin-releasing movement of the manually-movable pin-release means, to actuate the control means to move its pin-blocking means to move to its withdrawn position in which it does not block the latch pin from moving to a position withdrawn from platform-supportive engagement with the leg abutment, the arrangement providing that the latch pin is operatively blocked from moving to its withdrawn position sufficiently to release its platform-supporting abutting engagement with the leg abutment unless the manually-movable pin-release means is then in its pinreleasing position.

17. The invention as set forth in claim 16 in a combination in which the manually-movable pin-release means of the latch means has (a) a relatively inactive position in which it is not operatively engaging the latch pin to cause its movement to its said withdrawn position, and (b) a relatively active position in which it is causing such pin-movement, and in which the operative engageability of the actuator means of the control means with the manually-movable pin-release means, and the support of the movable control means, is such that for the manually-movable pin-release means to move from its said relatively inactive position to its said relatively active position, the actuator means of the control means moves in such a way that the pin-blocking means of the control means is moved from its said pin-blocking position of engagement with the latch pin to its said non-blocking position with respect to the latch pin.

18. The invention as set forth in claim 17 in a combination in which spring means are provided which bias the control means to a condition with the pin-blocking means in pin-blocking position, thus assuring that unless the manually-movable pin-release means is being moved into or is in operative engagement with the latch pin to effect latch-pin withdrawal, the pin-blocking means of the control means will be in position to block the latch pin against movement into withdrawn position.

19. The invention as set forth in claim 16 in a combination in which the control means comprises a member form to have a general L-shape, one leg of it being supported in a generally vertical orientation for providing the the pin-blocking means, and the other leg of which being supported in a generally horizontal orientation for providing the actuator means of the control means, and providing that the control means is cammed by the manually-movable pin-release means to move the pin-blocking means of the control means away from its pin-blocking position engaging the latch pin as the manually-movable pin-release means is being moved to achieve movement of the latch pin to its said withdrawn position of abutment-release with respect to the scaffold leg.

20. The invention as set forth in claim 17 in a combination in which the control means comprises a member form to have a general L-shape, one leg of it being supported in a generally vertical orientation for providing the pin-blocking means, and the other leg of which being supported in a generally horizontal orientation for providing the actuator means of the control means; and providing that the control means is cammed by the manually-movable pin-release means to move the pin-blocking means of the control means away from its pin-blocking position as the manually-movable pin-release means is being moved to achieve movement of the latch pin to its said withdrawn position of abutment-release with respect to the scaffold leg.

21. The invention as set forth in claim 18 in a combination in which the control means comprises a member form to have a general L-shape, one leg of it being supported in a generally vertical orientation for providing the pin-blocking means, and the other leg of which being supported in a generally horizontal orientation for providing the actuator means of the control means; and providing that the control means is cammed by the manually-movable pin-release means to move the pin-blocking means of the control means away from its pin-blocking position as the manually-movable pin-release means is being moved to achieve movement of the latch pin to its said withdrawn position of abutment-release with respect to the scaffold leg.

22. A latch means for a scaffold, the scaffold having a support leg having an abutment against which a latch pin of the latch means abuts for supporting a support platform of the scaffold, the latch pin being supported to be movable into and between (a) a support position in which it abuts the leg abutment for supporting the platform and (b) a withdrawn position in which the latch pin is removed from the leg abutment to an abutment-release position for permitting a change of position of the platform with respect to the leg, there being a pin-spring which biases the latch pin to its platform-supporting position in which it abuts the leg abutment, there being a release lever means, having an actuator portion and an actuated portion, the actuator portion being manually movable to cause the actuated portion to operatively engage the latch pin and to cause its movement to its said withdrawn position of leg-abutment-release, against the bias of the pin-spring, the improvement for such a latch means, comprising:

a movable control member having a pin-blocking means and an actuator means, support means which supports the control member in and between (a) a position in which its pin-blocking means is disposed in the path of, and in contact with the latch pin, thus blocking the latch pin from moving from its leg-abutting position of platform support to its withdrawn position, and (b) a position in which the control member's pin-blocking means is withdrawn from said path, and out of contact with said latch pin, thus permitting the latch pin to move to its withdrawn position of leg-abutment release, and the actuator means of the movable control member engaging the release lever means for coordinated movement such that the actuator means of the control member is moved in response to pin-releasing movement of the release lever means, to achieve movement of the control member to move its pin-blocking means to a withdrawn position in which the pin is movable to its withdrawn position of abutment-release with respect to the scaffold leg, the arrangement providing that the only time the latch pin can move to its withdrawn position sufficiently to release its abutment with the scaffold leg abutment of platform support is while the release lever means is being actuated to cause pin-withdrawal thrust upon the latch pin by force applied to the actuator portion of the release lever means.

23. The invention as set forth in claim 22, in a combination in which the control member is formed to have a general L-shape, one leg of it being supported in a generally vertical orientation for providing the pin-blocking means, and the other leg of which being supported in a generally horizontal orientation for providing the actuator means of the control member, and providing that the control member is moved by its being so interconnectd to the release lever means to move the pin-blocking means of the control member away from its pin-blocking position as the release lever means is being moved to achieve movement of the latch pin to its said withdrawn position of abutment-release with respect to the scaffold leg.

* * * * *

UNITED STATES PATENT AND TRADEMARK OFFICE

CERTIFICATE OF CORRECTION

PATENT NO. : 4,793,438

DATED : December 27, 1988

INVENTOR(S) : Eugene D. Perry

It is certified that error appears in the above-identified patent and that said Letters Patent is hereby corrected as shown below:

| | |
|---|---|
| Abstract, line 1 | Change "from" to "for" |
| Col. 1, line 18 | Change "said Patent" to "this inventor's prior U.S. Patent 3,396,817 (1968), as mentioned below," |
| Col. 7, line 15 | Change "thorugh" to "through" |
| Col. 7, line 66 | Change "arrown" to "arrow" |
| Col. 8, line 41 | Change "axis" to "is" |
| Col. 9, line 53 | Change "away 60" to "60 away" |
| Col. 15, line 55 | Before "presence" insert "accommodating the" |
| Col. 16, line 66 | Before "form" insert "of a" |
| Col. 17, line 13 | Before "form" insert "of a" |

UNITED STATES PATENT AND TRADEMARK OFFICE

CERTIFICATE OF CORRECTION

PATENT NO. : 4,793,438

DATED : December 27, 1988

INVENTOR(S) : Eugene D. Perry

It is certified that error appears in the above-identified patent and that said Letters Patent is hereby corrected as shown below:

Col. 17, line 27 Before "form" insert "of a".

Signed and Sealed this

Twenty-fourth Day of October, 1989

*Attest:*

DONALD J. QUIGG

*Attesting Officer*

*Commissioner of Patents and Trademarks*